US007039963B2

(12) United States Patent
Loberger et al.

(10) Patent No.: US 7,039,963 B2
(45) Date of Patent: May 9, 2006

(54) LAVATORY SYSTEM

(75) Inventors: John M. Loberger, Germantown, WI (US); David H. Roland, Cedarburg, WI (US)

(73) Assignee: Bradley Fixtures Corporation, Menomonee Falls, WI (US)

( * ) Notice: Subject to any disclaimer, the term of this patent is extended or adjusted under 35 U.S.C. 154(b) by 0 days.

(21) Appl. No.: 10/116,335

(22) Filed: Apr. 4, 2002

(65) Prior Publication Data

US 2003/0188380 A1 Oct. 9, 2003

(51) Int. Cl.
*E03C 1/02* (2006.01)

(52) U.S. Cl. ..... 4/639; 4/619; 4/654; D23/290

(58) Field of Classification Search ..... 4/619, 4/624, 639, 640, 642, 645, 631; D23/284, D23/290, 308; 312/140.3
See application file for complete search history.

(56) References Cited

U.S. PATENT DOCUMENTS

| | | | | | |
|---|---|---|---|---|---|
| 540,235 | A | * | 6/1895 | Clifford et al. | 4/640 |
| D30,136 | S | | 2/1899 | Eckerson | |
| D36,574 | S | | 10/1903 | Zipp | |
| D36,575 | S | | 10/1903 | Zipp | |
| D36,595 | S | | 10/1903 | Peet | |
| 937,509 | A | | 10/1909 | Carpenter | |
| 1,069,972 | A | * | 8/1913 | Metzger | 4/640 |
| 1,323,398 | A | * | 12/1919 | Leland | 4/640 |
| 1,616,313 | A | | 2/1927 | Farmer | |
| 1,659,851 | A | | 2/1928 | Brewington | |
| D81,754 | S | | 8/1930 | Mabee | |
| D100,310 | S | | 7/1936 | Blu | |
| D170,204 | S | | 9/1953 | Long | D80/11 |
| 2,908,019 | A | * | 10/1959 | Lyon, Jr. | 4/631 |
| D201,493 | S | | 6/1965 | Sundberg et al. | D4/2 |
| D210,131 | S | | 2/1968 | Rourke | D33/7 |
| D238,075 | S | | 12/1975 | Harris | |
| D251,795 | S | | 5/1979 | McCann | D23/58 |
| D260,678 | S | | 9/1981 | Hiller | D23/53 |
| 4,336,619 | A | | 6/1982 | Hinkel et al. | |
| D279,404 | S | | 6/1985 | Hiller | D23/62 |
| D326,711 | S | | 6/1992 | Lotito et al. | D23/290 |
| D336,572 | S | | 6/1993 | Gunderson et al. | D6/399 |
| 5,230,109 | A | | 7/1993 | Zaccai et al. | 4/645 |
| 5,253,376 | A | | 10/1993 | Fait | |
| 5,363,517 | A | | 11/1994 | Botsolas | |

(Continued)

FOREIGN PATENT DOCUMENTS

| | | | | |
|---|---|---|---|---|
| AT | 141398 | * | 4/1935 | 4/639 |

(Continued)

OTHER PUBLICATIONS

"Innovative Applications in Solid Surface," The Journal of the Solid Surface Industry, Jan./Feb. 2002, vol. 8, No. 1 (3 pages).

(Continued)

*Primary Examiner*—Robert M. Fetsuga
(74) *Attorney, Agent, or Firm*—Foley & Lardner LLP

(57) ABSTRACT

A lavatory system configured to accommodate a first person and a second person having different physical abilities than the first person is disclosed. The lavatory system includes a first station having a first upper surface and a second station having a second upper surface. The first upper surface is laterally and vertically offset from the second upper surface so that the first station is configured to accommodate the physical abilities of the first person and the second station is configured to accommodate the physical abilities of the second person.

39 Claims, 5 Drawing Sheets

U.S. PATENT DOCUMENTS

| | | | | |
|---|---|---|---|---|
| 5,369,818 | A | 12/1994 | Barnum et al. | 4/624 |
| 5,412,818 | A | 5/1995 | Chen | 4/642 |
| D361,372 | S | 8/1995 | Enthoven | D23/293.1 |
| D362,901 | S | 10/1995 | Dannenberg et al. | D23/290 |
| D364,675 | S | 11/1995 | Tebbe | D23/290 |
| 5,561,871 | A | 10/1996 | Laughton | 4/619 |
| 5,611,093 | A | 3/1997 | Barnum et al. | 4/624 |
| D387,144 | S | 12/1997 | Flaherty | |
| D393,700 | S | 4/1998 | Trueb et al. | |
| 5,819,335 | A | 10/1998 | Hennessy | 4/619 |
| D402,358 | S | 12/1998 | Bonnell | D23/290 |
| D411,876 | S | 7/1999 | Hafner et al. | D23/290 |
| D420,727 | S | 2/2000 | Hundley | D23/290 |
| D422,346 | S | 4/2000 | Svendsen | D23/285 |
| D428,477 | S | 7/2000 | O'Connell et al. | D23/290 |
| D431,288 | S | 9/2000 | Helmsderfer | |
| D435,893 | S | 1/2001 | Helmsderfer | |
| 6,212,707 | B1 | 4/2001 | Thompson et al. | 4/631 |
| D446,664 | S | 8/2001 | Petri | D6/427 |
| D448,585 | S | 10/2001 | Petri | D6/427 |
| D453,882 | S | 2/2002 | Petri | D6/436 |
| D462,195 | S | 9/2002 | Wang | D6/425 |
| 2003/0188380 | A1 | 10/2003 | Loberger et al. | |

FOREIGN PATENT DOCUMENTS

| | | | | |
|---|---|---|---|---|
| DE | 2304815 | * | 8/1974 | 4/640 |
| DE | G 93 04 270.1 U1 | | 9/1993 | |
| DE | G 93 04 160.8 U1 | | 9/1994 | |
| JP | 256632 | * | 10/1989 | 4/639 |

OTHER PUBLICATIONS

Brueton advertisement for undulatus bench, Home Design—The New York Times Magazine, 2 pages, no date given.

Bradley Corporation, The Bradley Express Lavatory System: "A look, a feel, an idea as solid as granite," bearing a designation "© 1996 Bradley Corporation.", 4 pgs.

Bradley Corporation, Terreon: "Shaping your designs," bearing a designation "© 1998 Bradley Fixtures Corporation.", 8 pgs.

Bradley Corporation, "Plumbing Fixtures," bearing a designation "2001.", 12 pgs.

International Search Report; International Application No. PCT/US2004/007675 including written opinion of the International Searching Authority; (7 pgs.); mailed Aug. 6, 2004.

* cited by examiner 90
98
96
90
98
100
88
106
96
90
100
96
104
98
38
106
94
22
86
44
100
102
88
104
38
24
28
46
18
46
12
28
18
26
20
10
20

FIGURE 4
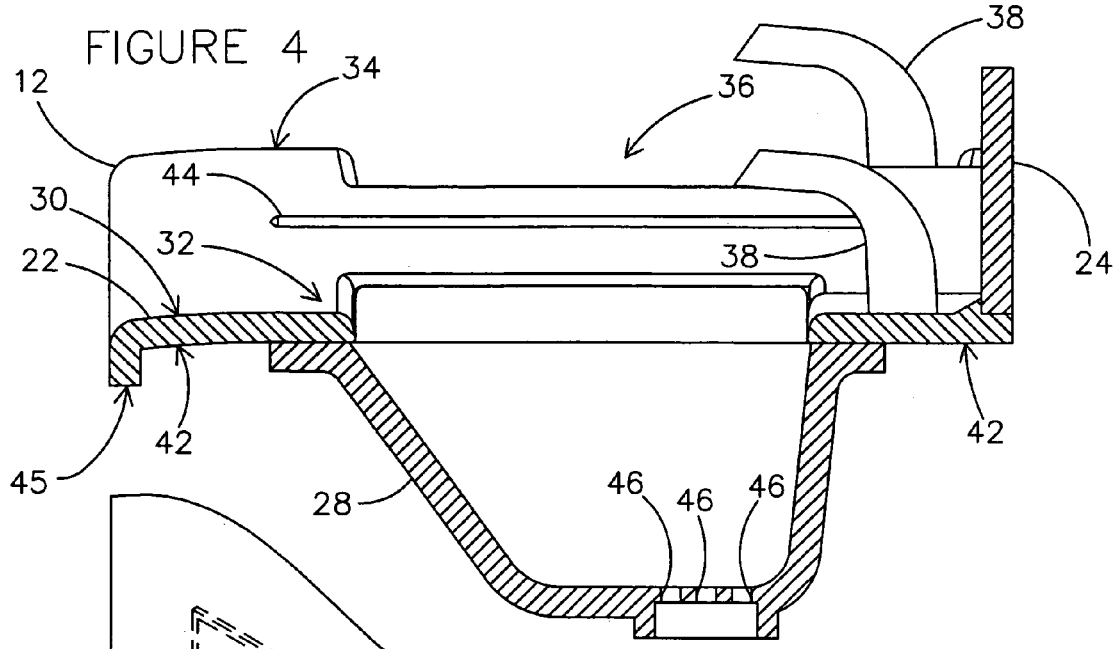
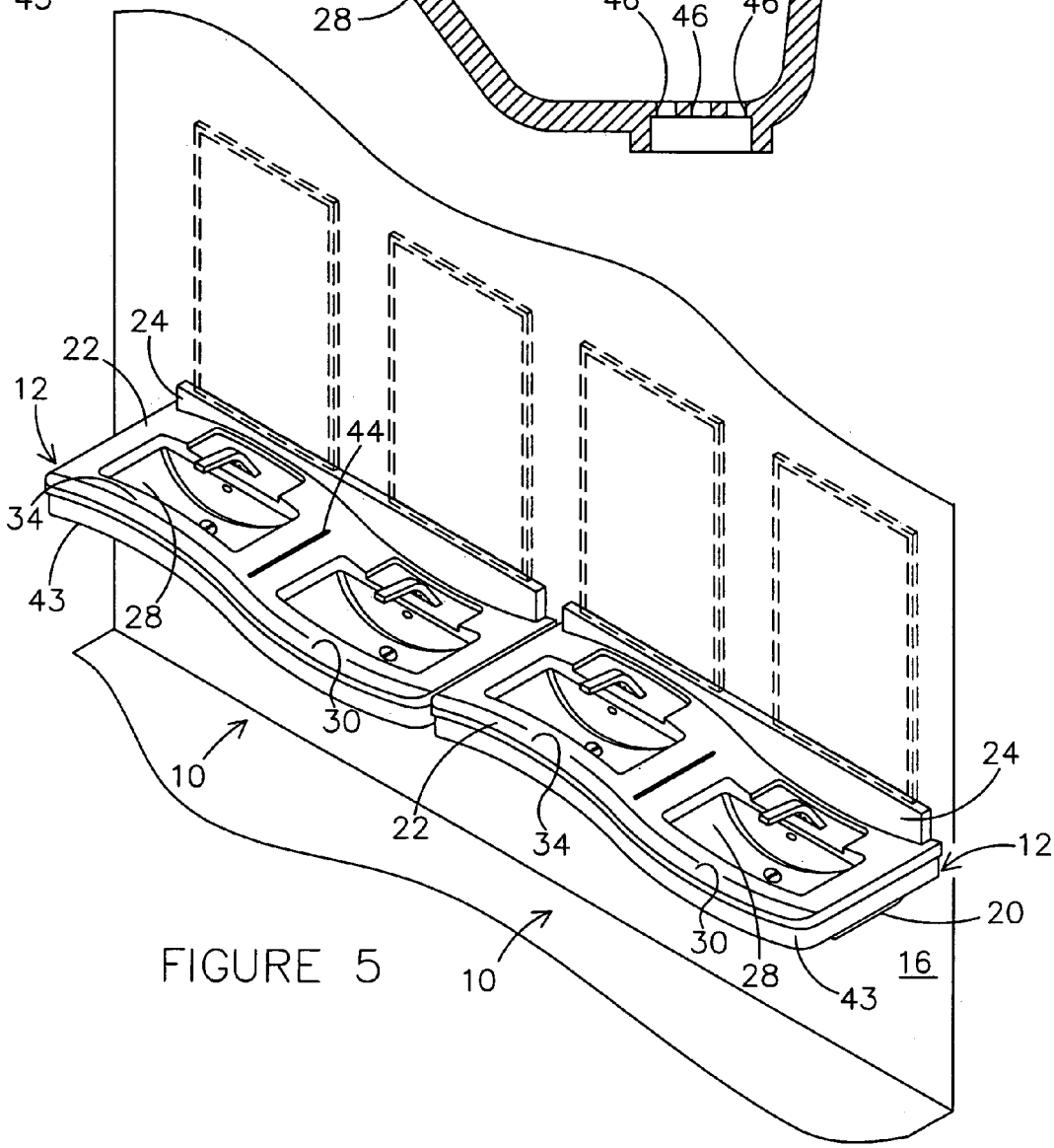
FIGURE 5

LAVATORY SYSTEM

CROSS REFERENCE TO RELATED APPLICATIONS

The drawings and figure descriptions of the following U.S. patent application is hereby incorporated herein by reference: U.S. Design patent application Ser. No. 29/158,504 titled "MULTIPLE TIER LAVATORY DECK" filed Apr. 4, 2002, now U.S. Pat. No. D477,060.

BACKGROUND OF THE INVENTION

The present invention relates to a lavatory system. More particularly, the present invention relates to a lavatory system with a multiple tier lavatory deck.

It is known to install a lavatory system in a public, commercial or industrial non-residential environment such as a restroom. Such known lavatory systems typically include one or more stations that provide lavatory services to one or more users. Such known lavatory systems also typically include a countertop, a backsplash, one or more wash basins (with drains), accommodating one or more faucets, and are adopted for plumbing to be coupled to the faucets (and drains). In such known lavatory decks, the countertop, is typically mounted to comply with Americans with Disabilities Act (ADA) Accessibility Guidelines for Buildings and Facilities and Uniform Accessibility Standards for Lavatories.

However, such known lavatory systems may not be conveniently or adequately usable or accessible by system users having various physical abilities. By designing the lavatory system for a particular physical ability, the lavatory system may be difficult, inconvenient or uncomfortable to use by users having other physical abilities.

Accordingly, it would be advantageous to provide for a lavatory deck that provides convenient and adequate access for various physical abilities of potential users. It would also be advantageous to provide a lavatory deck that provides access at multiple levels. It would further be advantageous to provide an integral lavatory deck having multiple level washing stations. It would further be advantageous to provide a lavatory deck with an accessory mounting structure. It would be desirable to provide for a multiple tier lavatory deck having one or more of these or other advantageous features.

SUMMARY OF THE INVENTION

The present invention relates to a lavatory system configured to accommodate a first person and a second person having different physical abilities than the first person. The lavatory system comprises a first station having a first upper surface and a second station having a second upper surface. The first upper surface is laterally and vertically offset from the second upper surface so that the first station is configured to accommodate the physical abilities of the first person and the second station is configured to accommodate the physical abilities of the second person.

The present invention also relates to an integral lavatory system configured to accommodate a first person and a second person having different physical abilities than the first person. The lavatory system comprises a first station having a first upper surface and a second station integral with the first station and having a second upper surface. The first upper surface is laterally and vertically offset from the second upper surface so that the first station is configured to accommodate the physical abilities of the first person and the second station is configured to accommodate the physical abilities of the second person.

The present invention further relates to a lavatory system configured to accommodate a first person and a second person having different physical abilities than the first person. The lavatory system comprises a first station having a first upper surface, a second station having a second upper surface, and a third station having a third upper surface and located between the first and second stations. The first, second, and third upper surfaces are laterally and vertically offset from each other so that the first, and second station is configured to accommodate the physical abilities of the first person and the third station is configured to accommodate the physical abilities of the second person.

The present invention further relates to various features and combinations of features shown and described in the disclosed embodiments.

DESCRIPTION OF THE FIGURES

FIG. 4 is a sectional view of the lavatory system of FIG. 1.

FIG. 5 is a perspective view of a lavatory system according to an exemplary embodiment.

DETAILED DESCRIPTION OF PREFERRED AND OTHER EXEMPLARY EMBODIMENTS

Figure 1:
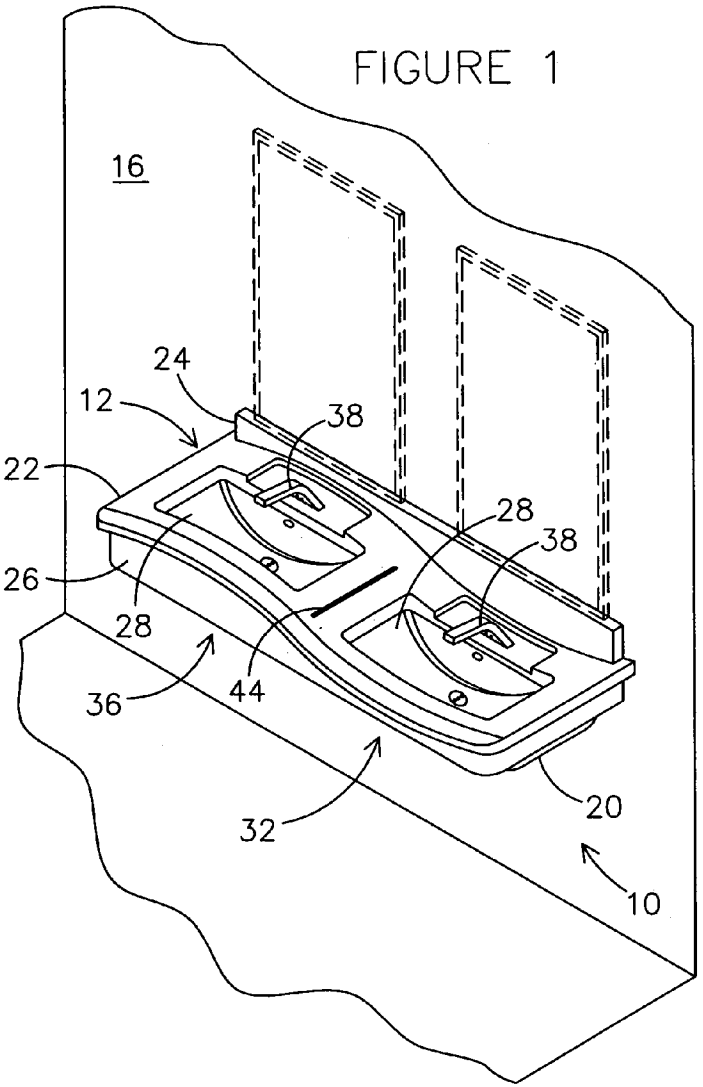
FIG. 1 is a perspective view of a lavatory system according to a preferred embodiment.

FIGS. 1–5 show a multilevel lavatory system 10 according to a preferred embodiment. Lavatory system 10 is configured to accommodate persons having varying abilities for using a lavatory system (e.g., disabled, tall, short, etc.). In addition to the ease of manufacturing and installation, lavatory system 10 incorporates a unitary lavatory subassembly that is efficient to manufacture, has a minimum number of components, and provides an independent handwashing station for users having varying physical attributes or abilities to attend to their washing needs. Also, this provides each user with an adequate sense of privacy while washing at a spaced distance from the next person using the lavatory system.

Lavatory system 10 includes a lavatory deck 12, a mounting arrangement configured to attach lavatory system 10 to an adjacent wall 16, a drain system 18 (shown in FIG. 2) disposed below lavatory deck 12, and a trap cover 20 configured to enclose plumbing system 18. Lavatory system 10 may be configured for attachment to a surface (such as wall 16 of a restroom or other area where it may be desirable to provide a lavatory services) with a plurality of connection points. Alternatively, the lavatory system may be configured as a free-standing structure. Adjacent wall 16 may be provided with the plumbing source (including both (or either) a hot and cold water supply, preferably combined with a thermostatic mixing valve, or a tempered water supply, a drain, etc.) and an optional source such as an electrical outlet (preferably providing 110 volts GFCI).

Lavatory deck 12 includes an arcuate countertop 22 with a backsplash 24 extending upwardly from countertop 22, and a front apron 26 extending downwardly from countertop 22.

Figure 3:
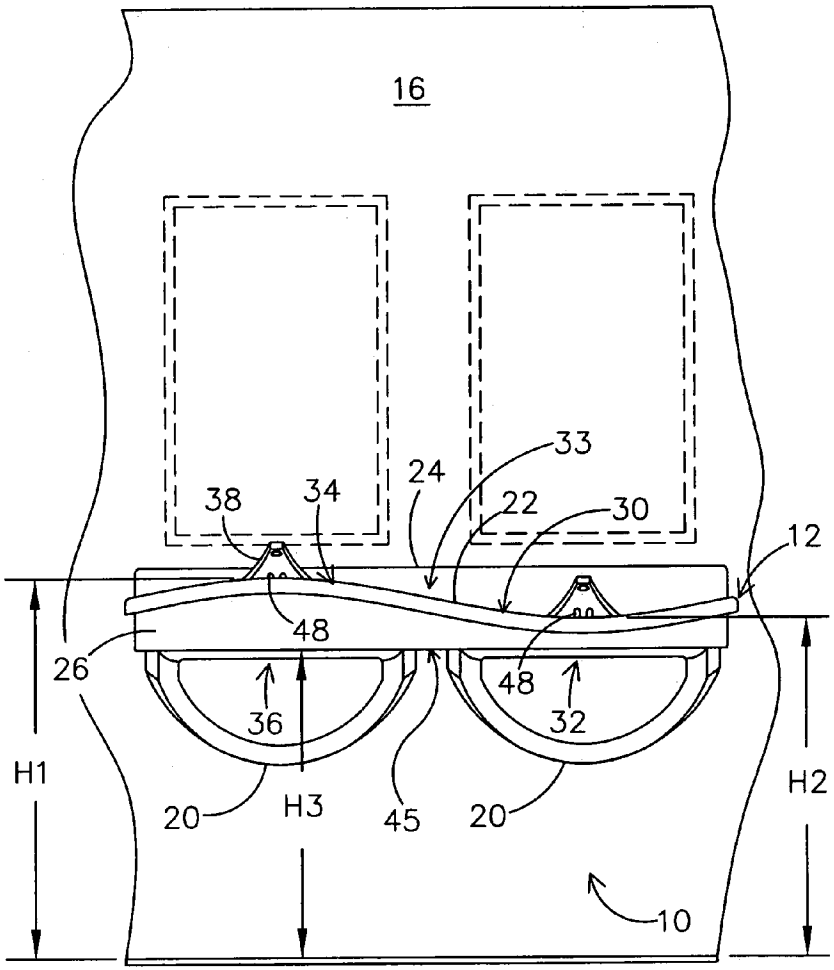
FIG. 3 is a front elevation view of the lavatory system of FIG. 1.

Countertop 22 may be configured in any of a variety of constructions intended to promote the drainage of spilled or splashed water to drain from countertop 22. Countertop 22 includes an upper surface 30 of a lower station 32 having a concave surface (e.g., the profile of the major surface has a first curvature) and an upper surface 34 of an upper station 36 having a convex surface (e.g., the profile of the major surface has a second curvature that is different than the first curvature). According to a preferred embodiment, countertop 22 includes a curved surface configured to prevent water from collecting (or "ponding"), to allow the excess, splashed, or spilled fluids to drain toward a bowl 28, and to facilitate clean-up. As shown in FIGS. 1 and 3, first station 32 is visually integral with second station 36 (and presents countertop 22 as a substantially continuous curved countertop) as visible from a front elevation view (e.g. FIG. 3) or a front perspective view (e.g. FIG. 1). According to an exemplary embodiment, the curved surface has a radius of curvature of between about 50 inches and 65 inches. According to a preferred embodiment, the curved surface has a radius of curvature of between about 55 inches and 60 inches. According to a particularly preferred embodiment, the curved surface has a radius of curvature of about 57 inches. Alternatively, the curved surface may have any of a variety of radii. According to an alternative embodiment, the lavatory deck has a sloped surface, a pitched surface. According to an alternative embodiment, the lavatory deck comprises two or more surfaces in a generally horizontal plane that are offset vertically and horizontally.

Lower station 32 and upper station 36 are configured to provide lavatory service and to accommodate persons having varying abilities for using the lavatory system (e.g., disabled, tall, short, etc.). According to any preferred embodiment, one or more stations of lavatory system 10 are mounted at a standard height that is designed to comply with the Americans with Disabilities Act (ADA) Accessibility Guidelines for Buildings and Facilities and Uniform Accessibility Standards for Lavatories. According to a particularly preferred embodiment, the height of the upper surface of the lavatory deck is approximately 34 inches (865 millimeters), provides a lower clearance (i.e., from the floor to the bottom of the apron) of at least 29 inches (735 millimeters) or less above the floor, and is equipped with a set of ADA compliant faucet assemblies. According to any preferred embodiment, lavatory system 10 is mounted with a counter surface no higher than thirty-one inches.

According to an exemplary embodiment, lower and upper stations 32, 36, are offset from each other to accommodate persons having varying abilities for using the lavatory system (e.g., disabled, tall, short, etc). Also, the offset station design is intended to provide the individual users of the lavatory system personal hand-washing space. According to a preferred embodiment, lower station 32 is offset vertically and laterally from upper station 36. Lower station 32 is mounted at a height that intended to comply with American National Standards Institute (ANSI) and ADA accessibility standards. According to a preferred embodiment, arcuate profile of the adjacent upper surfaces 30, 34 provide a corresponding transition 33 between concave and convex. Referring to FIG. 3, lavatory system 10 comprises a center or a middle of the first upper surface 34 that is spaced a first distance (H1) from a floor and a center or a middle of the second upper surface 30 that is spaced a second distance (H2) from the floor. The first distance H1 is greater than the second distance H2.

Figure 2:
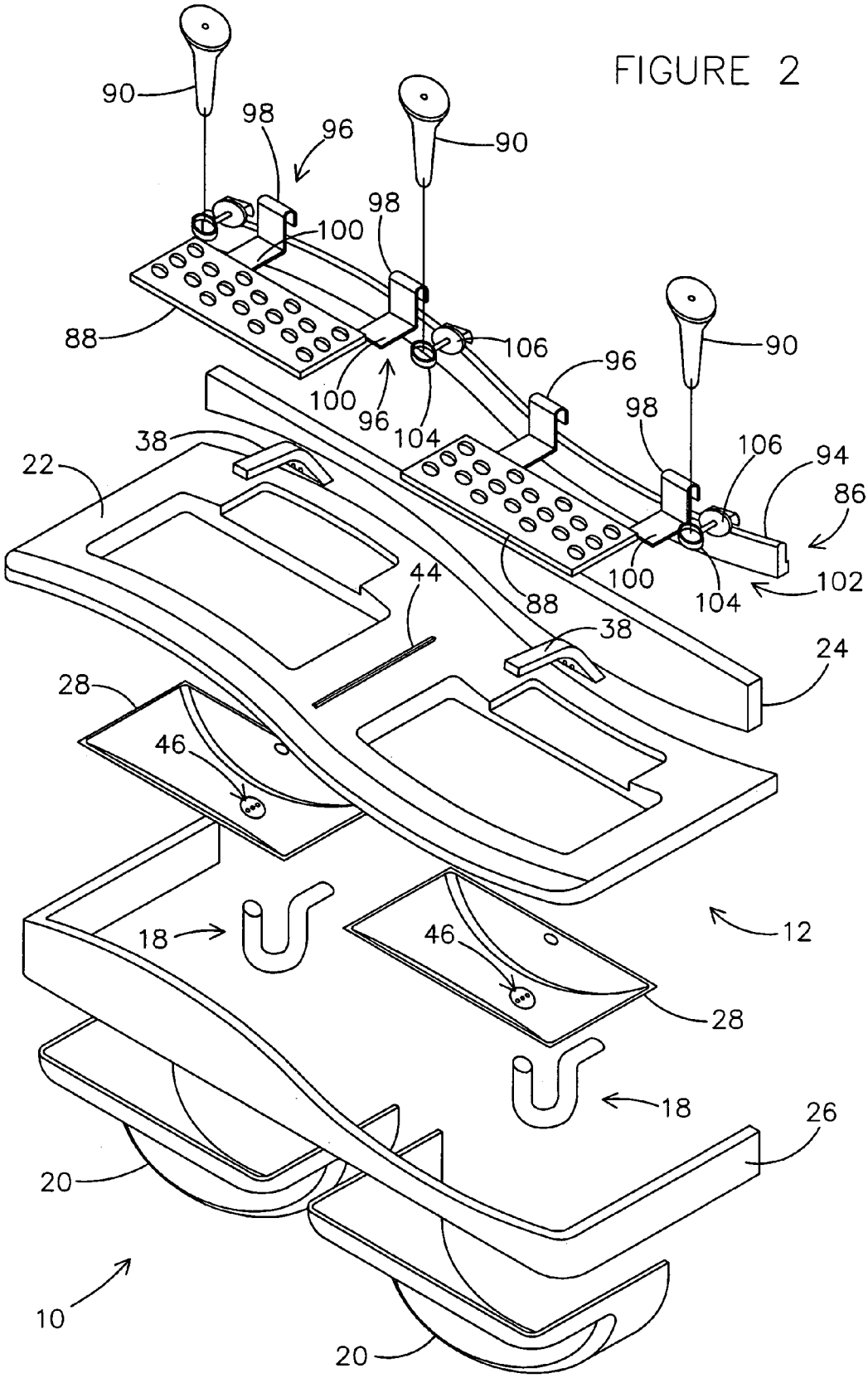
FIG. 2 is an exploded perspective view of the lavatory system of FIG. 1 with an accessory mounting structure.

Lower and upper stations 32, 36 each includes a basin or receptacle (shown as bowl 28) and a faucet assembly 38. Lower and upper stations 32, 36 may also include a dispenser attached to countertop 22 adjacent bowl 28 and an overflow conduit. As shown in FIGS. 1 and 3, basin or bowl 28 of lower station 32 is located at a height that is different than the basin 28 of upper station 36 relative to the floor (e.g., the height or distance that bowl 28 of lower station 32 is from or relative to the floor is less than the height or distance that bowl 28 of upper station 36 is from or relative to the floor). According to a preferred embodiment shown in FIG. 4, bowl 28 is attached to a bottom surface of countertop 22, and has an upper periphery that is sized to be larger (or approximately the same) than the aperture is countertop (e.g., so that the bowl reveal seam is hidden). According to a particularly embodiment, the adhesive used for attaching any separate component of the lavatory deck (e.g., the bowl to the countertop) is the MA 600 Adhesive commercially available from LTW Plexus of Danvers, Maryland. Bowl 28 may be attached by any number of a variety of methods of attachment including an adhesive, a fastener with a gasket, or the like), or separate component may be a drop-in component configured to be attached to upper surface 30, 34 of countertop 22 by any number of a variety of methods of attachment (including fasteners, adhesive, friction, or the like). According to an alternative embodiment, bowl 28 may be any number of a variety of shapes and configurations. As shown in FIG. 2, the top of basin or bowl 28 for at least one of the upper station and lower station may be generally horizontal. According to an exemplary embodiments, two or more differently configured (e.g., size, shape, etc.) are provided. According to an alternative embodiment the bowl is an integrally formed component of lavatory deck 12. According to another exemplary embodiment, the bowls are formed (e.g., molded or cast) with the lavatory deck. According to an exemplary embodiment, the drainage for bowls 28 is provided by a plurality of linear holes 46 in the bottom of each bowl 28.

Front apron 26 is designed to provide a contoured frontal surface to conceal certain components of lavatory system 10 and may have any number of a variety of contours or shapes. According to a preferred embodiment shown in FIG. 3, front apron 26 extends downward from countertop 22 and conceals a portion of trap cover 20 that attaches to a bottom surface 42 of countertop 22 and includes a generally planer horizontal lower surface 45 so that the lower surface 45 of apron 26 at lower station 32 is vertically aligned with the lower surface 45 of apron 26 at upper station 36. According to an exemplary embodiment shown in FIG. 5, an apron 43 is contoured (e.g., curved or arcuate). (For example, apron 43 extends down from countertop 22 by a consistent value or dimension.) According to alternative embodiments, the apron may have any of a variety of configurations.

Backsplash 24 is designed to protect the wall adjacent to countertop 22 (e.g., from water splashed from the hand-washing lower and upper stations 32, 36 or other physical damage). The lower edge of apron 26 and the upper edge of the backsplash 24 have horizontal edges such that the arcuate or curved surface is provided by the countertops.

According to a preferred embodiment, countertop 22 includes a liquid barrier 44 (shown as a ridge or rib) is located between each of stations 32, 36 and is configured to prevent liquids from the upper station 36 from draining towards lower station 32. Barrier 44 projects (or stepped up) from upper surfaces 30, 34 of countertop 22. According to an alternative embodiment, the liquid barrier can be a projection, slot, channel, or the like.

Lavatory deck 12 may be made from any of a variety of solid surface materials, stainless steel, laminates, fiberglass, and the like. According to a particular preferred embodiment, the lavatory deck is made from a densified solid surface material composed of an acrylic modified polyester resin that complies with ANSI Z124.3 and Z124.6. According to a particularly preferred embodiment, the surface material is of a type commercially available under the trade name TERREON® from Bradley Corporation of Menomonee Falls, Wis. The lavatory deck is intended to be resistant to chemicals, stains, burns, and impact such that surface damage can easily be repaired with everyday cleaners or fine grit abrasives. According to a preferred embodiment, lavatory deck 12 is molded from a mixture of resin, filler, pigment, and catalyst, which forms a liquid when combined. The liquid mixture is poured or cast into a gel-coated fiberglass mold at a filler hole (i.e., "mold hole"). According to an alternative embodiment, filler holes are located midway between the basins.

A method of forming the lavatory deck according to a particularly preferred embodiment is as follows: (a) the mold is coated with a gel; (b) the resin, filler, pigment, and catalyst are each measured and are mixed; (c) the liquid mixture is cast or injected into a filler hole of the gel-coated fiberglass mold and allowed to cure until it can be removed from the mold; (d) the lavatory deck is removed from the mold and post-cured (e.g., heated to further rune and relief internal stresses); (e) the flash is removed from the lavatory deck; (f) the surface is prepared by polishing, sanding, or other finishing processes; (g) any additional operations (e.g., machining, drilling holes and adding inserts, or the like) are done prior to shipping and/or assembling the lavatory system. According to alternative embodiments, the mold is prepared according to the desired lavatory deck configuration with inserts and blocks.

According to exemplary embodiments, the lavatory deck may be integrally molded to include certain combinations of its components, such as the countertop, back splashguard and the front apron. According to alternative embodiments, the lavatory deck can be integrally molded to include additional or other combinations of components, such as one or both of the side aprons, the backsplash and/or or other of the side splashguards. According to other alternative embodiments, the lavatory deck can be integrally formed (e.g. integrally molded or cast) into any of a variety of shapes and sizes, having any of a variety of dimensions and geometries (e.g., curved or other forms) that may or may not require or include certain of the components.

Trap cover 20 is configured to enclose drain system 18 and any electrical supply/components, and conceal components below countertops and all supply and waste connections. Trap cover is attached to countertop 22 and/or adjacent wall 16 by fasteners (shown as screws). According to a preferred embodiment, trap cover 20 is designed to comply with all ADA Accessibility Guidelines for Buildings and Facilities, and Uniform Accessibility Standards for Lavatories. Trap cover 20 has an upper lip configured to rest against bottom surface 42 of countertop 22 and provide a plurality of apertures for fasteners configured to secure trap cover 20 to countertop 22. According to an exemplary embodiment, the trap cover is a hair cell textured Acrylonitrile Butadiene Styrene (ABS) plastic with dull finish. As shown in FIGS. 2 and 3, an individual trap cover 20 is mounted at each lower and upper station 32, 36. According to an alternative embodiment, a single trap cover spans substantially the width of the lavatory deck to cover the plumbing system of more than one station.

Faucet assembly 38 includes an activation mechanism (not shown), a sensor (shown as an infrared sensor 48) and conduit (not shown). Activation mechanism is configured to permit and prohibit water flow according to an input. Infrared sensor 48 include a sender and a receiver, and is configured to send an output signal when the user places his or her hands near bowl 28. According to alternative embodiments, the faucet assembly may be activated by any number of a variety commercially available sensors (including mechanical metering, infrared activation, battery operated infrared, battery operated infrared with temperature control infrared activation). According to a preferred embodiment, the detection area for infrared sensor 48 does not exceed the perimeter of bowl 28. According to an alternative embodiment, the sensor may be a separate fixture mounted to the countertop. According to any preferred embodiment, the faucet assembly may be any of a variety of conventional or commercial available faucet assemblies.

According to a particularly preferred embodiment, faucet assembly is a "no-touch" faucet in the form of a Bradley Futura Model 900 adaptive sensor module commercially available from Bradley Fixtures Corporation of Menomonee Falls, Wis. Infrared sensor 48 electronically activates a twenty-four volt solenoid valve using a 24-volt AC, 50/60 Hz power supply; faucet assembly 38 includes chrome-plated, solid cast brass body with a center-shank-mounting. According to an alternative embodiment, faucet assembly 38 may be any number of a variety of commercially available water delivery fixtures including those having manually operated activation mechanisms.

According to alternative embodiments, shown in FIGS. 5–9 the size of the lavatory system may be varied and may provide one or more number of hand-washing stations having any variety of spacing configurations.

Figure 7:
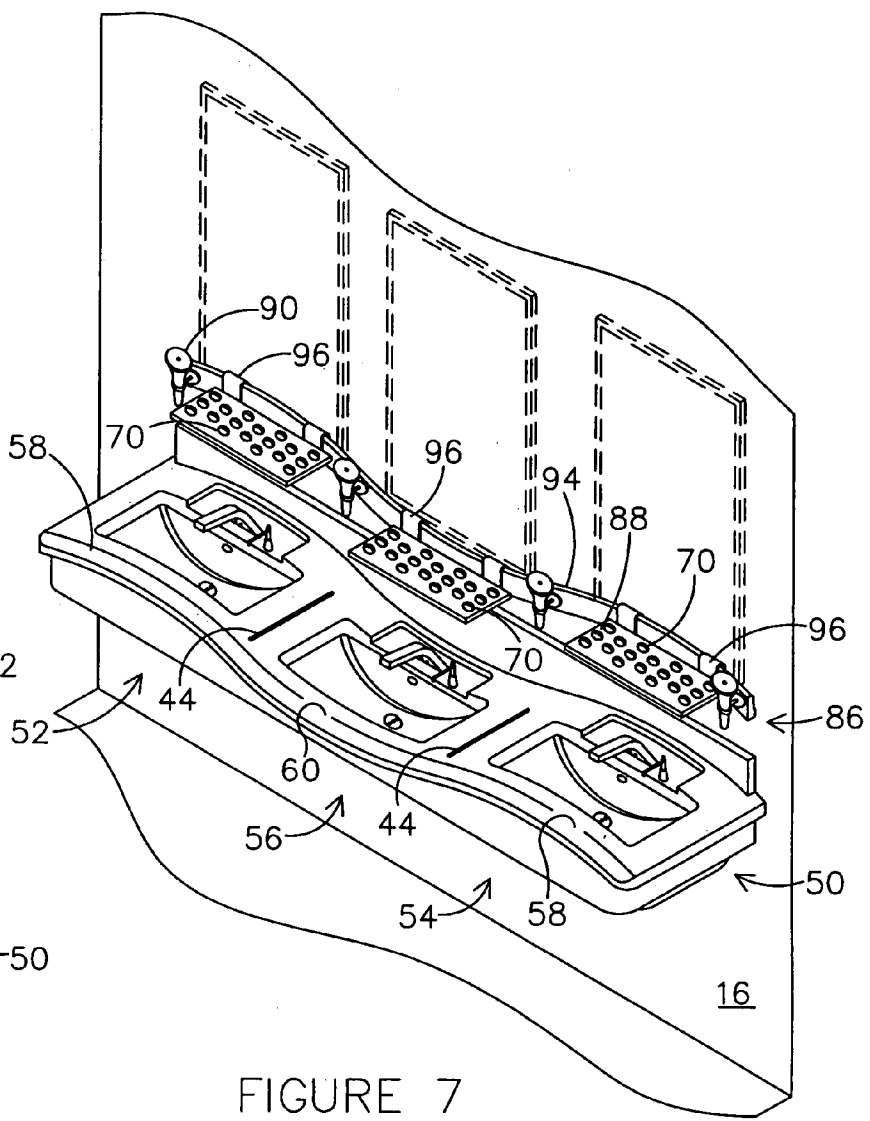
FIG. 7 is a perspective view of a lavatory system according to an exemplary embodiment.
Figure 6:
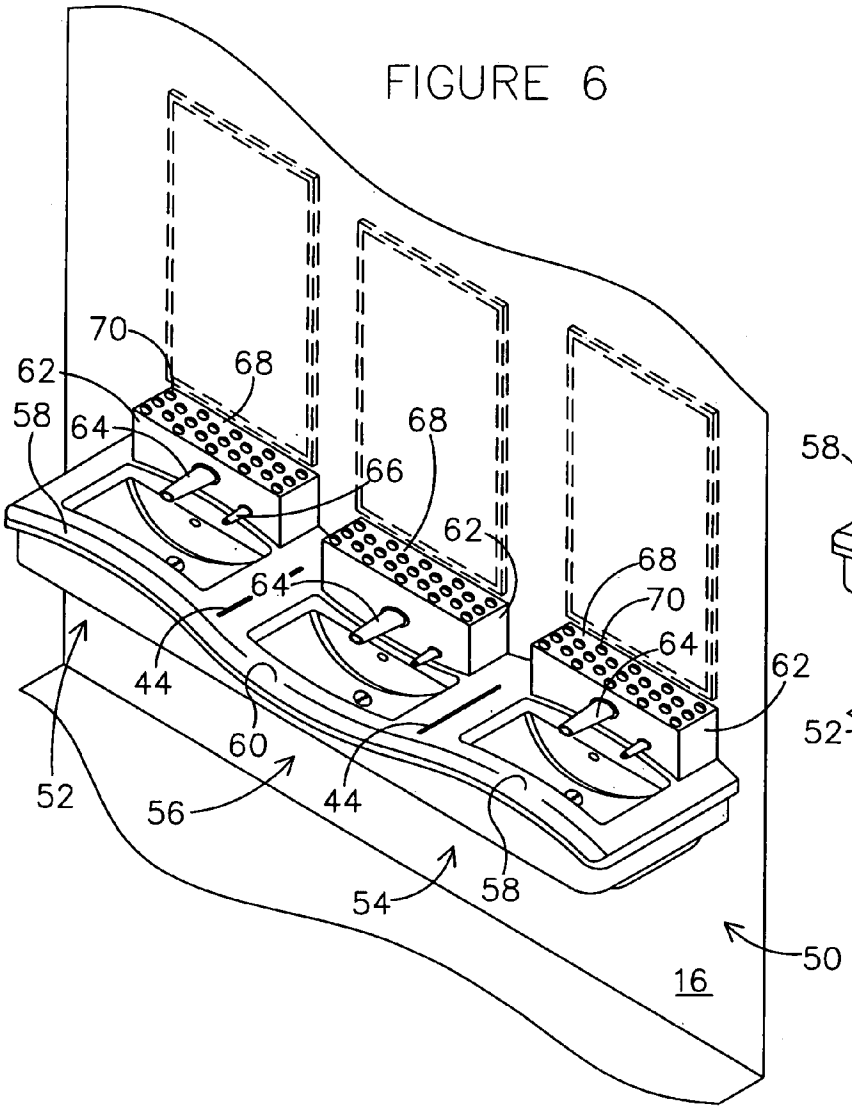
FIG. 6 is a perspective view of a lavatory system according to an exemplary embodiment.

FIGS. 6 and 7 show a lavatory system 50 according to an alternative embodiment. Lavatory system 50 includes three stations (shown as an upper station 52, an upper station 54, and a lower station 56). Upper stations 52, 54 include an upper surface 58 that is offset (i.e., vertically and laterally) from an upper surface 60 of lower station 56. As such, lower station 56 is configured to comply with ANSI and ADA accessibility standards. Upper stations 52, 54 of lavatory system 50 are configured to provide comfortable and convenient accessibility to persons having other physical abilities. According to an alternative embodiment, the lavatory system includes two stations with upper surfaces that are vertically offset lower than the upper surface of the third station. According to an alternative embodiment, the lavatory system includes stations that have three (or more) different upper surface heights. According to an alternative embodiment, the lavatory system includes two adjacent stations with upper surfaces that are vertically offset higher than the upper surface of the third station. According to an alternative embodiment, the lavatory system includes two adjacent stations with upper surfaces that are vertically offset lower than the upper surface of the third station. These two adjacent stations having comparable heights may be located at either end or side of the lavatory system (e.g., left or right). According to alternative embodiments, the lavatory system may have any of a variety of combinations of "higher" or "lower" stations arranged in any of a variety of order or configuration. According to further alternative embodiments, the lavatory may have any number of stations arranged at two or more heights.

Referring to FIG. 6, a base 62 (e.g., pedestal, box, etc.) is provided at each upper and lower station 52, 54, 56. Base 62 includes a faucet assembly 64 and a dispenser shown as soap dispenser 66. Base 62 also includes an upper surface 68 configured to provide space for storing items while the user uses lavatory station. According to a preferred embodiment, upper surface 68 includes one or more projections 70 configured to provide a dry surface to support personal items such as purses, briefcases, documents, or the like. Projections 70 are disposed on a portion or the upper surface 68 of base 62 and is formed by ribs or spherical projections (shown as spherical projections in FIG. 6) extending upward from upper surface 68 of base 62 or by grooves, slots, or channels recessed from upper surface 68. According to an alternative embodiment, the raised surface is a single flat surface sized and designed to have the dimensions of articles typically requiring stowing during hand-washing (e.g., purses, wallets, briefcases, files, etc.) According to a particularly preferred embodiment, the raised surface is raised approximately ¼ to ½ inch above the upper surface of the countertop.

Figure 8:
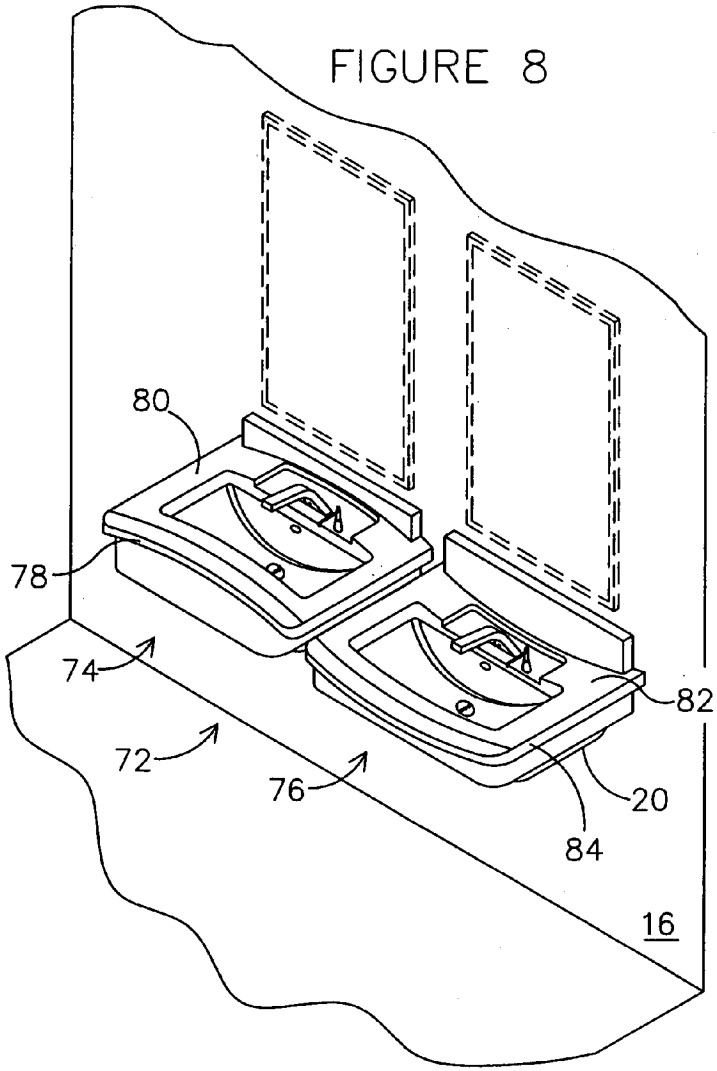
FIG. 8 is a perspective view of a lavatory system according to an exemplary embodiment.
Figure 9:
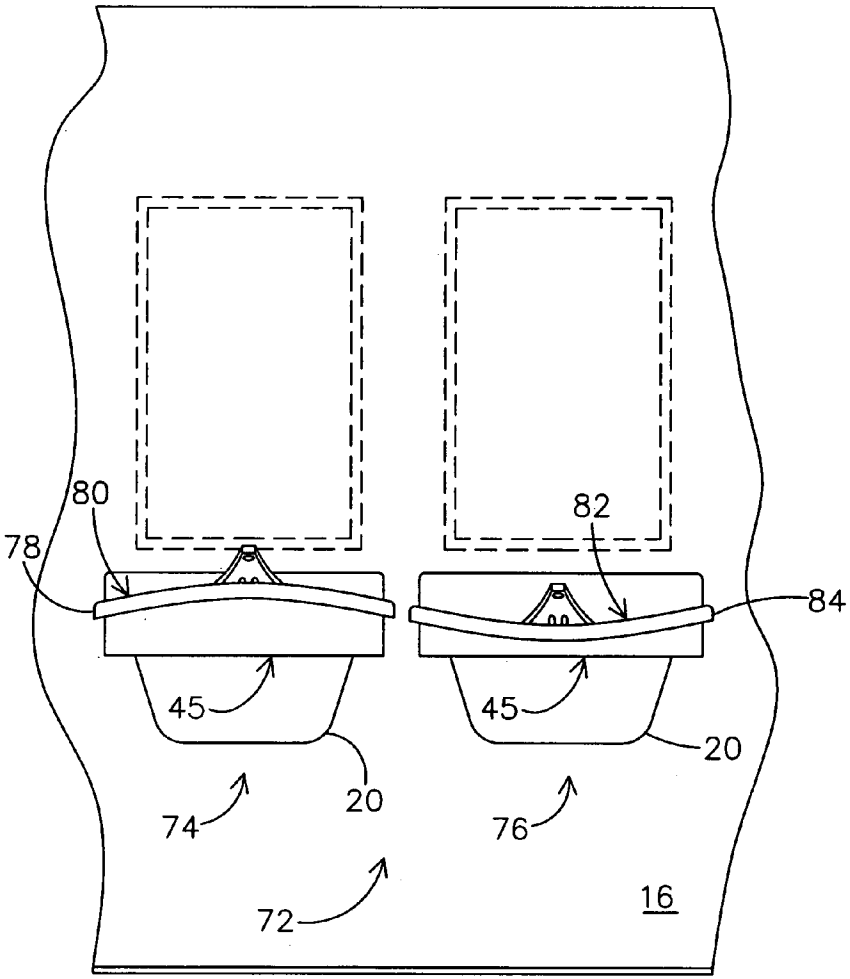
FIG. 9 is a front elevation view of the lavatory system of FIG. 8.

FIGS. 8 and 9 show a lavatory system 72 according to an alternative embodiment. Lavatory system 72 includes an upper station 74 and a lower station 76. Upper station 74 has an arcuate countertop 78 with an upper surface 80 that is vertically and laterally offset from an upper surface 82 of an arcuate countertop 84 of (adjacent) lower station 76. Upper station 74 and lower station 76 are separate structures (i.e., non-integral or non-unitary) that are configured to be visually integral (i.e., provide the appearance of a continuous design). The arcuate profile of the adjacent countertops 78, 84 provide a corresponding transition between concave and convex.

Referring to FIGS. 2 and 7, the lavatory system may include a mounting structure 86 configured to provide support for any of a variety of accessories, (e.g., a shelf 88 a bud vase 90, mirror, monitor, light fixture, or the like). Mounting structure 86 includes an arcuate base member 94 (e.g., rail, bar, tube, etc.) mounted to wall 16. (Alternatively, the base member may be mounted to the lavatory deck or other structure.) Each shelf 88 includes a pair of brackets 96 having a shelf support member 98 and a base member interface 100 (shown as a downward facing channel). Shelves 88 may be fastened to brackets 96 by fasteners or the like. Each vase 90 includes a bracket 102 having vase support member 104 and a base member interface 106. According to alternative embodiments, the base member, support members, or the base member interfaces may have any of a variety of shapes or configurations.

It is also important to note that the construction and arrangement of the elements of the multiple tier lavatory deck as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the lavatory system may have any number of stations located at any number of heights. Also, the lavatory deck may have any of a variety of configurations, materials, and stations. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A lavatory system comprising:

a first station comprising a countertop section with an upper surface comprising a convex profile, a basin, and an area within the convex profile and between the basin and a front edge of the countertop section of the first station;

a second station comprising a countertop section with an upper surface comprising a concave profile, a basin, and an area within the concave profile and between the basin and a front edge of the countertop section of the second station;

wherein the convex profile of the first station and the concave profile of the second station form a substantially continuous curved countertop comprising the countertop section of the first station and the countertop section of the second station;

wherein the area within the convex profile of the countertop section of the first station is at a height different than the area within the concave profile of the countertop section of the second station.

2. The lavatory system of claim 1 wherein the substantially continuous curved countertop is visible from a front of the countertop.

3. The lavatory system of claim 1 wherein the countertop comprises a transition between the first station and the second station.

4. The lavatory system of claim 3 wherein the transition between the first station and the second station is continuous so that the convex profile of the first station is visually integral with the concave profile of the second station.

5. The lavatory system of claim 4 wherein the countertop is integrally formed.

6. The lavatory system of claim 1 wherein the countertop comprises a barrier located between the first station and the second station, the barrier being configured to inhibit liquids from passing between the first station and the second station.

7. The lavatory system of claim 6 wherein the barrier comprises a rib.

8. The lavatory system of claim 1 wherein the countertop comprises an apron extending generally downward from the countertop.

9. The lavatory system of claim 1 wherein the countertop comprises a backsplash extending generally upward from the countertop.

10. The lavatory system of claim 1 wherein the basin of the first station is coupled to the countertop section of the first station at a first opening in the countertop section of the first station.

11. The lavatory system of claim 1 wherein the basin of the second station is coupled to the countertop section of the second station adjacent to a second opening in the countertop section of the second station.

12. The lavatory system of claim 1 wherein the substantially continuous curved countertop progresses laterally from an end of the first station along the convex profile of the countertop section of the first station to a middle of the first station and to a transition between the first station and the second station and then from the transition between the first station and the second station along the concave profile of the countertop section of the second station to a middle of the second station and to an end of the second station.

13. The lavatory system of claim 12 wherein the middle of the upper surface of the countertop section of the first station is provided at a first height and the middle of the upper surface of the countertop section of the second station is provided at a second height, wherein the first height is greater than the second height.

14. The lavatory system of claim 1 wherein the the first station comprises a first faucet assembly and the second station comprises a second faucet assembly.

15. The lavatory system of claim 1 wherein the concave upper surface is vertically offset below the convex upper surface.

16. The lavatory system of claim 1 wherein the first station and the second station are configured to accommodate users having different physical abilities.

17. A lavatory system configured to include at least a first fixture and a second fixture comprising:

a first station comprising a countertop with an upper surface comprising a convex profile, a basin within the convex profile, and an area configured for attachment of the first fixture;

a second station comprising a countertop with an upper surface comprising a concave profile, a basin within the convex profile, and an area configured for attachment of the second fixture;

a substantially continuous curved countertop comprising the countertop of the first station adjacent to the countertop of the second station and progressing from an end of the first station along the convex profile of the upper surface of the first station to a center of the first station and to a transition between the first station and the second station and then from the transition between the first station and the second station along the concave profile of the upper surface of the second station to a center of the second station and to an end of the second station;

wherein the area configured for attachment of the first fixture is at a height different than the area configured for attachment of the second fixture.

18. The lavatory system of claim 17 wherein the transition between the first station and the second station is continuous so that the convex profile of the upper surface of the countertop of the first station is visually integral with the concave profile of the upper surface of the countertop of the second station.

19. The lavatory system of claim 17 wherein the convex profile of the upper surface of the countertop of the first station is provided at a first height and the concave profile of the upper surface of the countertop of the second station is provided at a second height.

20. The lavatory system of claim 19 wherein the first height is greater than the second height.

21. The lavatory system of claim 17 wherein the transition is provided as an intersection of the first station and the second station.

22. The lavatory system of claim 17 wherein the transition is provided as an interface of the first station and the second station.

23. The lavatory system of claim 17 wherein the countertop of the first station and the countertop of the second station are integrally formed.

24. The lavatory system of claim 17 wherein the countertop of the first station is integrally molded with the countertop of the second station.

25. The lavatory system of claim 23 wherein the countertop of the first station is cast with the countertop of the second station.

26. The lavatory system of claim 17 further comprising the first fixture and the second fixture and wherein the first fixture is a faucet and the second fixture is a faucet.

27. The lavatory system of claim 17 wherein the area configured for attachment of the first fixture comprises a generally planer surface and the area configured for attachment of the second fixture comprises a generally planer surface.

28. The lavatory system of claim 17 wherein the basin of the first station is substantially identical to the basin of the second station.

29. The lavatory system of claim 17 wherein the basin of the first station is at a first height and the basin of the second station is at a second height that is different than the first height.

30. The lavatory system of claim 17 wherein the basin of the first station is accessible at a first height.

31. The lavatory system of claim 30 wherein the basin of the second station is accessible at a second height.

32. The lavatory system of claim 31 wherein the first height is greater than the second height.

33. The lavatory system of claim 17 wherein the first station comprises a lower surface and the second station comprises a lower surface.

34. The lavatory system of claim 33 wherein the lower surface of the first station is provided at a first height and the lower surface of the second station is provided at a second height.

35. The lavatory system of claim 34 wherein the first height is substantially identical to the second height.

36. The lavatory system of claim 17 wherein the first station comprises a first hand-washing station and the second station comprises a second hand-washing station.

37. The lavatory system of claim 17 further comprising a barrier located at the transition between the first station and the second station.

38. The lavatory system of claim 37 wherein the barrier is configured to inhibit liquids from passing between the first station and the second station.

39. The lavatory system of claim 38 wherein the barrier is a rib.

* * * * *